US006983736B2

(12) United States Patent
Mitchell et al.

(10) Patent No.: US 6,983,736 B2
(45) Date of Patent: Jan. 10, 2006

(54) GOVERNOR STABILIZER

(75) Inventors: Robert Mitchell, Pewaukee, WI (US); Richard A. Dykstra, Cedar Grove, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 172 days.

(21) Appl. No.: 10/317,761

(22) Filed: Dec. 12, 2002

(65) Prior Publication Data

US 2004/0112333 A1 Jun. 17, 2004

(51) Int. Cl.
*F02D 31/00* (2006.01)

(52) U.S. Cl. ..... 123/376; 123/363

(58) Field of Classification Search ..... 123/376, 123/363, 372, 400, 403, 404, 405, 398, 198 DB
See application file for complete search history.

(56) References Cited

U.S. PATENT DOCUMENTS

| | | | |
|---|---|---|---|
| 1,128,782 | A | 2/1915 | Hartford |
| 1,265,883 | A | 5/1918 | Church |
| 2,134,889 | A | 11/1938 | Phillip |
| 2,138,100 | A | 11/1938 | Howard |
| 2,221,201 | A | 11/1940 | Pope, Jr. et al. |
| 2,338,912 | A | 1/1944 | Ericson |
| 2,367,606 | A | 1/1945 | Olson |
| 2,529,437 | A | 11/1950 | Weinberger |
| 2,533,180 | A | 12/1950 | Rhodes |
| 2,544,607 | A | 3/1951 | Mallory |
| 2,585,814 | A | 2/1952 | McDonald |
| 2,613,657 | A | 10/1952 | Sloane et al. |
| 2,635,596 | A | 4/1953 | Adler |
| 2,716,397 | A | 8/1955 | Heinish |
| 2,781,751 | A | 2/1957 | Benjamin |
| 2,867,196 | A | 1/1959 | Francis |
| 3,139,079 | A | 6/1964 | Bettoni |
| 3,276,439 | A | 10/1966 | Reichenbach |
| 3,354,873 | A | 11/1967 | Burnell |
| 3,659,499 | A | 5/1972 | Woodward |
| 3,666,057 | A | 5/1972 | Leifer et al. |
| 3,760,785 | A | 9/1973 | Harrison et al. |
| 3,847,131 | A | 11/1974 | Hisatomi |
| 3,881,685 | A | 5/1975 | Hase et al. |
| 3,937,302 | A | 2/1976 | Palmerantz |
| 3,971,356 | A | 7/1976 | Schlage |
| 3,997,019 | A | 12/1976 | Inoue |
| 4,022,179 | A | 5/1977 | Kalert et al. |
| 4,103,652 | A | 8/1978 | Garside et al. |
| 4,176,642 | A | 12/1979 | Shipinski |
| 4,304,202 | A | 12/1981 | Schofield |
| 4,355,611 | A | 10/1982 | Hasegawa |
| 4,383,510 | A | 5/1983 | Nakamura et al. |
| 4,526,060 | A | 7/1985 | Watanabe |
| 4,530,334 | A | 7/1985 | Pagdin |
| 4,567,870 | A | 2/1986 | Tumber |

(Continued)

FOREIGN PATENT DOCUMENTS

| | | | |
|---|---|---|---|
| GB | 14914 | | of 1915 |
| JP | 61207836 | | 9/1986 |
| JP | 1193750 | * | 4/1999 |
| RU | 853138 | | 8/1981 |

*Primary Examiner*—Mahmoud Gimie
(74) *Attorney, Agent, or Firm*—Michael Best & Friedrich LLP

(57) ABSTRACT

A stabilizer system creates a temporary droop to stabilize a governor for an internal combustion engine and reduce permanent droop and hunting of the engine. The governor adjusts the position of a throttle in response to engine speed to achieve a desired engine speed. The stabilizer system temporarily applies a force on the governor that initially resists sudden movement of the governor arm, and causes a temporary speed droop. The initial resistance of the stabilizer system helps prevent the governor from overshooting the desired speed and hunting. The temporary droop is then removed to permit the governor to achieve the desired speed to help prevent permanent droop.

41 Claims, 7 Drawing Sheets

U.S. PATENT DOCUMENTS 4,640,245 A 2/1987 Matsuda et al.
4,709,675 A * 12/1987 Fujita ..... 123/376
4,773,369 A 9/1988 Kobayashi et al.
4,793,309 A 12/1988 Huffman et al.
4,836,167 A * 6/1989 Huffman et al. ..... 123/376
4,884,541 A 12/1989 Marriott
4,941,443 A 7/1990 Yamaguchi et al.
4,977,879 A 12/1990 Schmidt et al.
5,003,949 A 4/1991 Fanner et al.
5,060,744 A 10/1991 Katoh et al.
5,069,180 A * 12/1991 Schmidt et al. ..... 123/376
5,146,889 A 9/1992 Swanson et al.
5,208,519 A 5/1993 Dykstra et al.
5,235,943 A * 8/1993 Fiorenza, II ..... 123/179.18
5,293,854 A 3/1994 Tracy et al.
5,351,529 A 10/1994 Locke, Sr.
5,459,664 A * 10/1995 Buckalew ..... 701/99
5,479,908 A 1/1996 Grinberg et al.
5,503,125 A 4/1996 Gund
5,526,786 A 6/1996 Beck et al.
5,595,531 A 1/1997 Niemela et al.
5,642,711 A 7/1997 Boner et al.
D382,853 S 8/1997 Crawford
5,680,024 A 10/1997 Ehle et al.
5,726,503 A 3/1998 Domanski et al.
5,810,560 A * 9/1998 Tanaka ..... 416/27
6,021,370 A 2/2000 Bellinger et al.
6,113,193 A 9/2000 Kunzeman
6,276,449 B1 8/2001 Newman
6,365,982 B1 * 4/2002 Iles et al. ..... 290/40 B
2002/0053339 A1 * 5/2002 Bottle et al.

* cited by examiner

GOVERNOR STABILIZER

FIELD OF THE INVENTION

This invention relates to internal combustion engines, and more particularly to a governor assembly for internal combustion engines.

BACKGROUND OF THE INVENTION

Governors are generally used to regulate the speed of internal combustion engines. Some prior art governors include electronic governors, mechanical governors having centrifugally-responsive flyweights, or air vane governors. A governor maintains an engine at a relatively stable speed. The governor generally receives an input indicative of engine speed, and actuates an engine throttle accordingly to adjust the engine speed to a desired speed. If the engine speed is too low, the governor may adjust the throttle to increase engine speed. If the engine speed is too high, the governor may adjust the throttle to decrease engine speed.

FIG. 1 illustrates a prior art governor 310 including flyweights 314 having flanges 318 that move a plunger 322. The plunger 322 engages a governor lever 326, which is interconnected to a governor arm 330. The governor 310 may also include a governor shaft that connects the governor lever 326 to the governor arm 330. A throttle link 334 is connected to the governor arm 330 and an engine throttle 338. A governor spring 342 applies a biasing force on the governor arm 330. The flyweights 314 cause the governor lever 326 to move in response to engine speed, thereby causing the throttle 338 to be adjusted to control engine speed.

Conditions associated with governors include speed droop and hunting. The engine speed generally drops when a load is applied to the engine, and this drop in engine speed is called "speed droop." The amount of speed droop is a characteristic of a particular engine, and is in part determined by spring rate and the tension applied to the governor spring 342.

Hunting, or searching, generally occurs when a governor changes the engine speed. The governor may overshoot the desired engine speed, and the governor then oscillates back and forth about the desired speed until the governor settles on the desired speed. Hunting or searching is the movement back and forth as the governor locates the desired speed. Hunting is also in part determined by spring rate and the tension applied to the governor spring.

The governor 310 generally moves the governor arm 330 in response to engine speed. Initially, the engine generally runs at a desired no-load engine speed partly determined by the initial tension of the governor spring 342. After a load is applied on the engine, the engine speed generally decreases below the desired no-load speed, and the governor 310 adjusts the throttle 338 in an attempt to increase the engine speed to the desired speed. Similarly, after a load is removed, the engine speed increases above the desired no-load speed, and the governor 310 adjusts the throttle 338 in an attempt to decrease the engine speed back down to the desired speed. In the illustrated embodiment, the governor 310 adjusts the throttle 338 by pivoting the governor arm 330, which actuates the throttle link 334. The governor spring 342 applies a biasing force on the governor arm 330 and the throttle link 334.

The selection of the spring rate of the governor spring 342 affects the performance of the governor 310. Droop and hunting are generally functions of the spring rate of the governor spring 342. The governor spring 342 applies a biasing force on the governor arm 330. Permanent speed droop may be reduced by lowering the spring rate of the governor spring 342 to reduce the force the governor spring 342 applies on the governor arm 330. A lower spring rate provides a "looser" feel for the governor 310 and permits the governor 310 to quickly react to speed changes since there is less resistance. However, lowering the spring rate of the governor spring 342 too much generally produces other engine speed concerns, such as hunting or searching. Since the spring rate is lower, the governor spring 342 provides less of a stabilizing force, and the governor 310 may fluctuate about the desired speed. The variation in engine speed caused by hunting causes a surging of the engine. The surging is audible and creates additional noise from the engine. Due to noise restrictions and other factors, additional noise from the engine is generally undesirable.

Hunting may be reduced by increasing the spring rate of the governor spring 342 to increase the force the governor spring 342 applies on the governor arm 330. Increasing the spring rate of the governor spring 342 provides a "tighter" feel for the governor 310 and may help reduce hunting or searching because there is less freedom of movement of the governor arm 330. However, increasing the spring rate of the governor spring 342 also increases permanent speed droop after a load is applied. Since the spring 342 has a higher spring rate, the governor spring 342 provides more stabilizing force to maintain a steady speed and reduce hunting. However, the additional resistive force of the spring 342 may prevent the governor 310 from actually achieving the desired speed, which results in permanent droop.

Due to permanent droop, the desired no-load engine speed often must be increased to compensate for the permanent droop. This is accomplished by increasing the initial tension of the governor spring 342. For example, if the desired no-load speed for an engine is 3,000 rpm, the permanent droop of the governor may only permit the engine speed to return to 2,800 rpm while a load is applied. Therefore, the engine experiences a permanent speed droop of approximately 200 rpm. The no-load speed may then be increased to 3,200 rpm to permit the engine to achieve the desired engine speed of 3,000 rpm under load, due to the permanent speed droop. Increasing the no-load engine speed also increases the noise generated by the engine. As mentioned above, additional noise from the engine is generally undesirable.

In FIG. 2, the graph illustrates test data of the engine speed over time in response to various loads placed on an engine having a prior art governor 310 (FIG. 1). In the test, the load (measured in Watts "W") on the engine was from a generator. The engine was subjected to alternating periods of no load, and incrementally increasing loads. The alternating periods of no load and loads were each approximately 40 seconds in duration. In FIG. 2, the no-load speed is set at approximately 3800 rpm. Segments 350, 358, 366, 374, 382, and 390 illustrate the engine with no load (represented by "N.L.") at approximately 3800 rpm. Segments 354, 362, 370, 378, and 386 show the engine with incrementally increasing loads, in which the engine speed decreases from the previous no load condition.

Each decrease in engine speed during the application of a load is a speed droop, and the speed droop increases with increasing loads. In the graph, as the 2050 W load is applied between segments 382 and 386, the engine speed initially decreases, or undershoots, to about 3200 rpm before increasing back to about 3600 rpm. The approximately 200 rpm difference between 3800 rpm and 3600 rpm represents the permanent speed droop, since it remains the entire time the load is applied.

Generally, a governor spring 342, as shown in FIG. 1, having a lower spring rate provides a faster response and more accuracy, but may provide less stability. The governor 310 will quickly get in the general range of the desired engine speed, providing accuracy, but the speed will fluctuate within that range, resulting in less stability. A governor spring 342 having a higher spring rate generally provides more stability, but may have slower response, and less accuracy. The governor 310 will enable the engine to reach a certain engine speed, and will maintain that speed, providing stability. However, that certain engine speed may not be the desired speed, and is normally lower than the desired speed, resulting in less accuracy.

SUMMARY OF THE INVENTION

The present invention provides an apparatus that helps control the speed of an internal combustion engine having an engine throttle. The apparatus comprises a governor that adjusts the position of the throttle to set the engine speed to a desired speed. The governor includes a governor arm assembly, which may include a governor arm and/or a governor extension that moves in response to engine speed and that engages the governor arm. The governor also comprises a throttle link interconnected to the governor arm assembly and to the throttle. The apparatus also comprises a stabilizer system interconnected to the governor, and preferably to the governor arm assembly. Alternatively, the stabilizer system may be interconnected to the throttle link. The stabilizer system includes a damper and a stabilizer spring interconnected in series to a fixed part of the engine.

The stabilizer system creates a temporary droop to stabilize the governor and reduce permanent droop and hunting. Permanent speed droop includes a reduction in engine speed as long as the load is applied, and temporary speed droop includes an initial reduction in engine speed upon application of the load and a substantial return to the original engine speed while the load is still applied. In one embodiment, the stabilizer system temporarily applies a force on the governor arm assembly that initially resists quick movement of the governor arm assembly, and causes a temporary speed droop to inhibit the governor arm assembly from moving too quickly. The initial resistance of the stabilizer spring helps prevent the governor from undershooting or overshooting the desired speed and hunting for the desired speed. After the movement of the governor arm assembly has slowed, the resistive force of the stabilizer system is reduced. The temporary droop is then removed to permit the governor to achieve the desired speed to help prevent permanent droop.

The stabilizer system allows the engine to maintain speed and power without setting the desired no-load speed of the governor too high. Since permanent droop is reduced, the desired no-load speed may be lowered, which reduces noise emitted from the engine, and increases fuel efficiency. Additionally, the stabilizer system helps reduce hunting, which also reduces noise emitted from the engine due to surging, and increases fuel efficiency.

Independent features and independent advantages of the present invention will become apparent to those skilled in the art upon review of the following detailed description and drawings.

Figure 1:
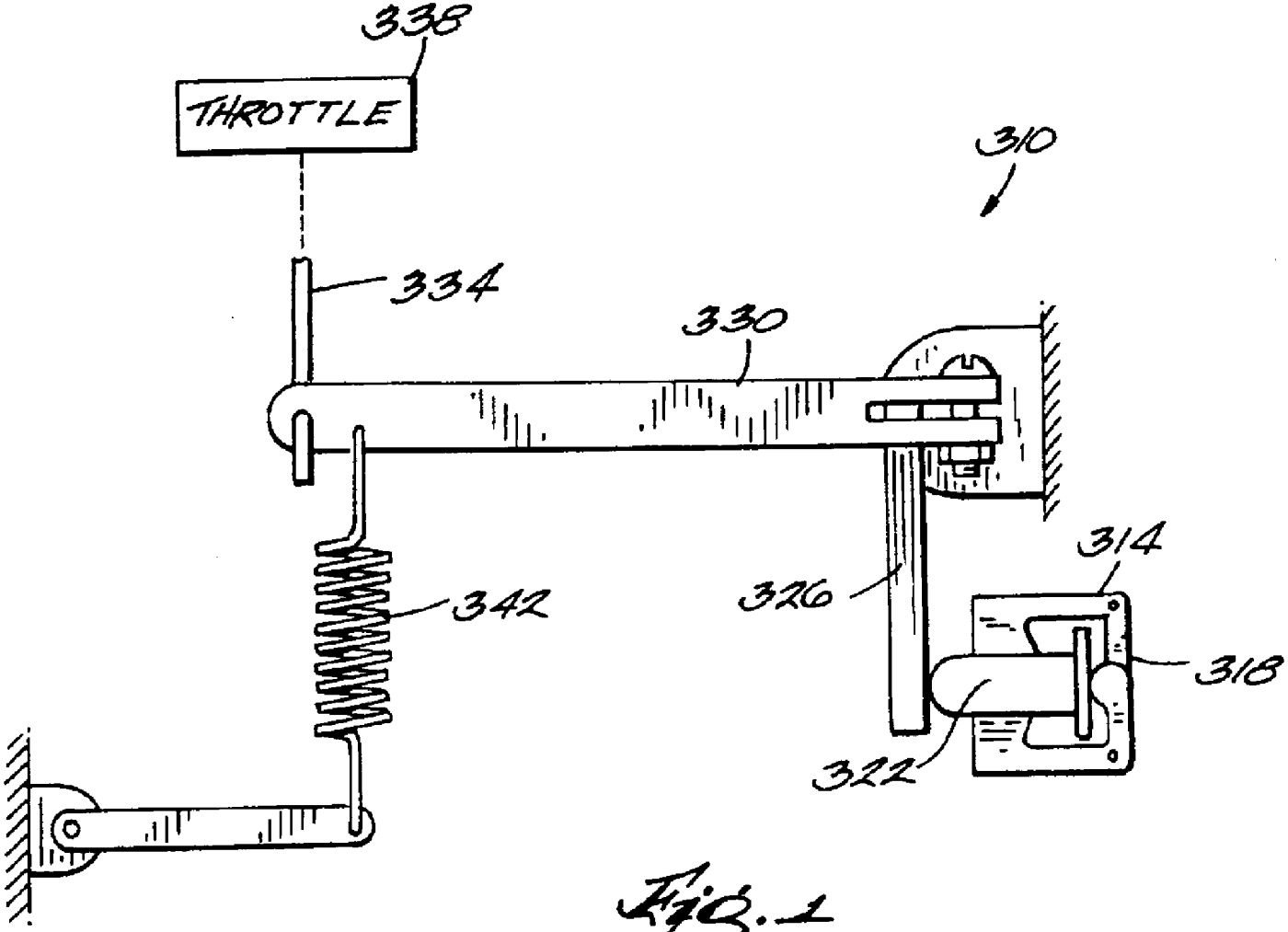
FIG. 1 PRIOR ART
FIG. 1 is a diagram of a prior art governor.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references may be made below to directions, such as left, right, up, down, top, bottom, front, rear, back, etc., in describing the drawings, these references are made relative to the drawings (as normally viewed) for convenience. These directions are not intended to be taken literally or limit the present invention in any form.

DETAILED DESCRIPTION

Figure 3:
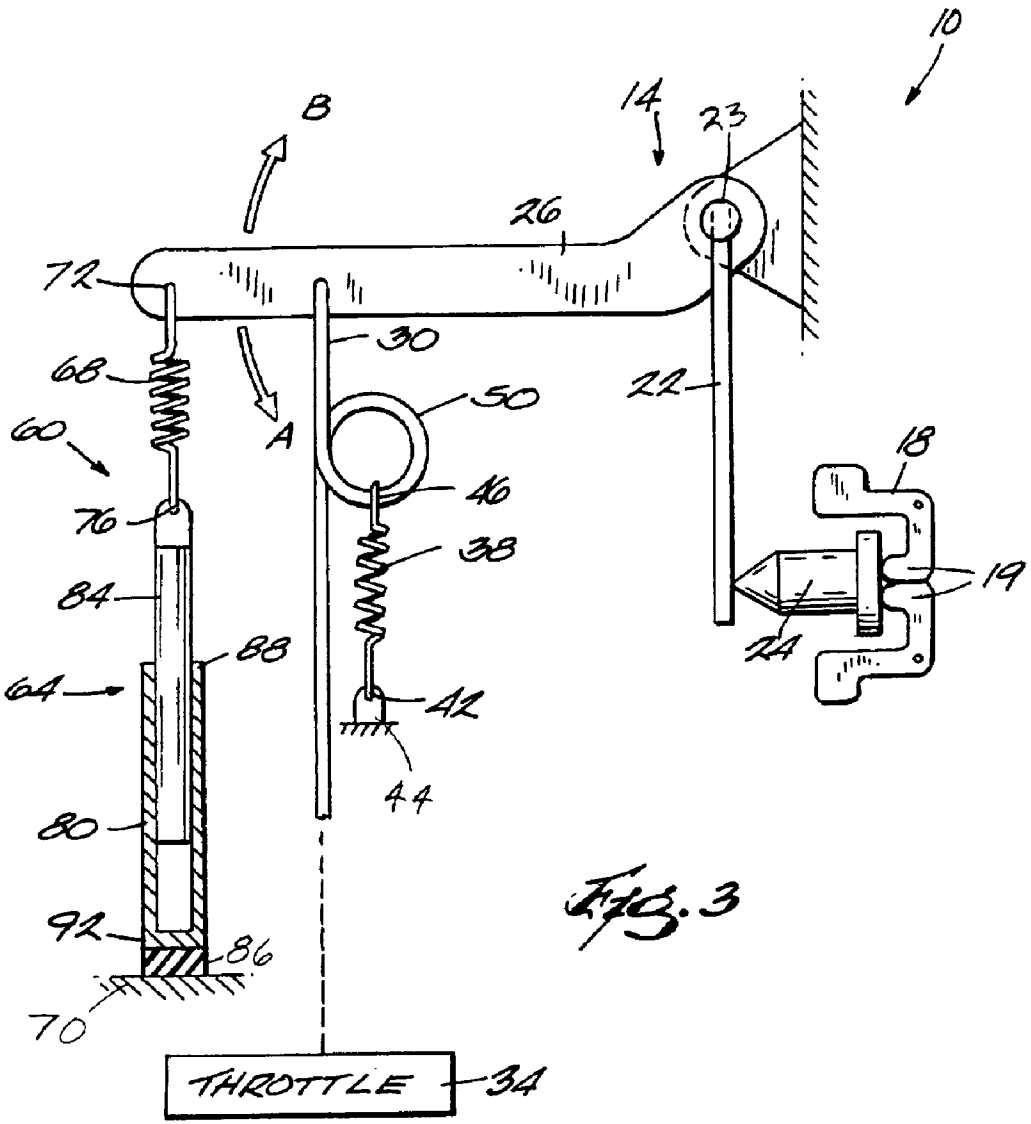
FIG. 3 is a diagram of a governor system including a stabilizer system according to the present invention.
Figure 4:
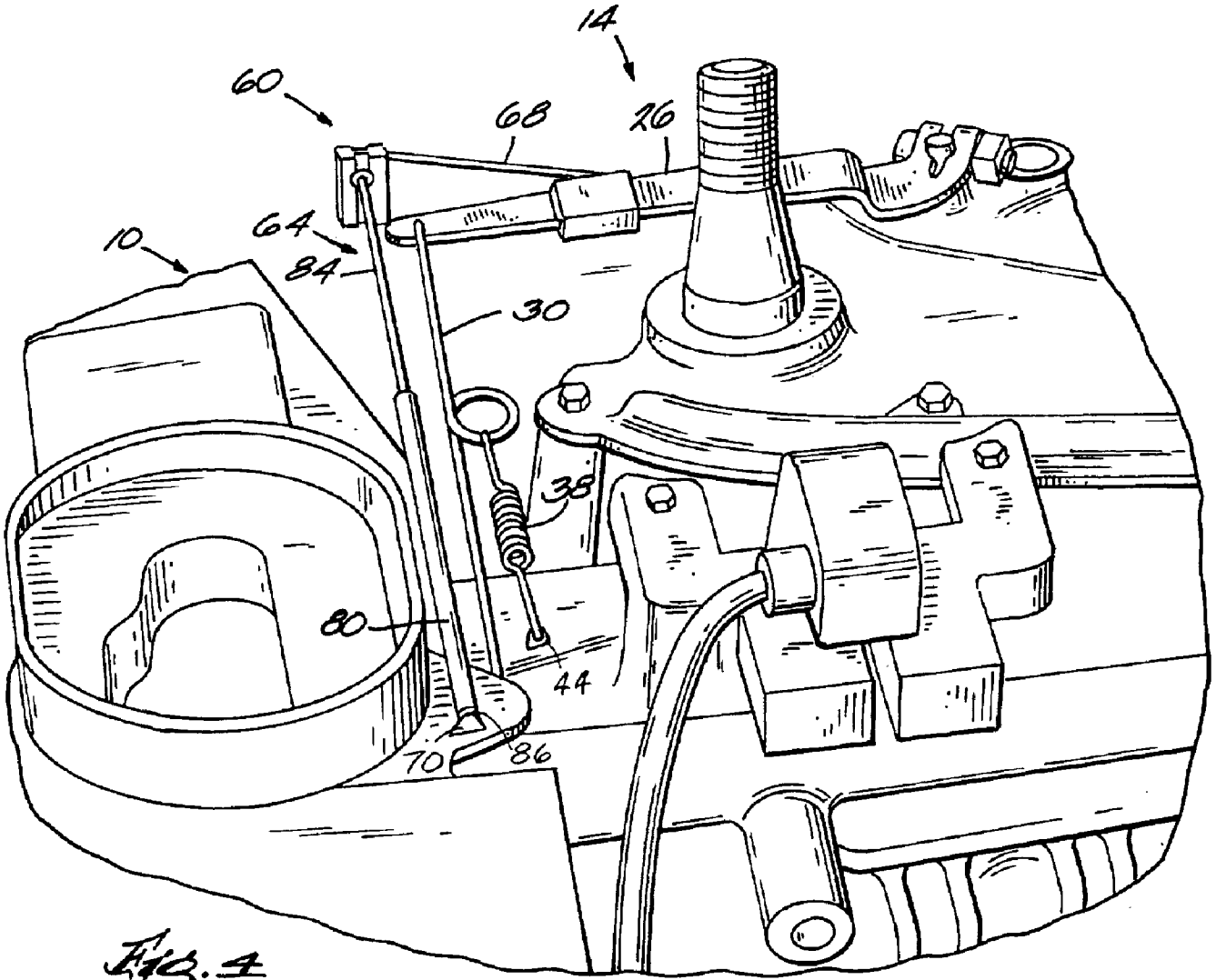
FIG. 4 is a perspective view of an engine including the governor system having a stabilizer system.

FIG. 4 illustrates an internal combustion engine 10 including a governor 14. FIG. 3 illustrates a diagram of the governor 14 in more detail. In FIGS. 3 and 4, the governor 14 includes centrifugally-responsive flyweights 18 having flanges 19 that move a plunger 24 in response to engine speed. Plunger 24 then moves a governor extension 22. The centrifugally-responsive flyweights 18 respond to the engine speed, and its flanges 19 cause plunger 24 to move toward the governor extension 22 as the engine speed increases, and away from the governor extension 22 as the engine speed decreases. Flyweights 18 are interconnected with a pinion gear (not shown) that is driven by another gear, as well-known in the art.

In the illustrated embodiment, the governor extension 22 is interconnected to a shaft 23, and the shaft 23 is interconnected to a governor arm 26. The shaft 23 extends between the governor extension 22 and the governor arm 26. In the illustrated embodiment, the shaft 23 extends substantially transverse to the governor arm 26, and the governor extension 22 extends in a substantially radial direction from the shaft 23. However, the governor extension 22, governor shaft 23, and governor arm 26 may be interconnected at a variety of angles. The governor shaft 23 may be used to offset the flyweights 18 and plunger 24 from the governor arm 26. Alternatively, the governor extension 22 may be connected to the governor arm 26, and the shaft 23 may not be needed.

In FIG. 3, the flyweights 18 cause the plunger 24 to move the governor extension 22 in response to engine speed. The governor extension 22 pivots with respect to the shaft 23 in response to movement of the plunger 24. The governor arm 26 is mounted to pivot with respect to the engine 10. The pivoting movement of the governor extension 22 causes the shaft 23 to rotate, and rotation of the shaft 23 causes the governor arm 26 to pivot with respect to the engine. The governor arm 26 may pivot in a first direction A when engine speed decreases, and a second opposite direction B when engine speed increases.

A throttle link 30 is interconnected to the governor arm 26 and an engine throttle 34. The throttle 34 regulates the air/fuel mixture that enters the engine 10 to control engine speed, and the throttle link 30 actuates the throttle 34. The governor 14 also includes a governor spring 38 that applies a biasing force on the governor arm 26 via throttle link 30. The governor spring 38 includes a first end 42 that is connected to a fixed portion 44 on the engine 10, and a second end 46 that is interconnected to a moving part of the governor 14. In the illustrated embodiment, the throttle link 30 includes a loop 50 between the governor arm 26 and the throttle 34, and the second end 46 of the governor spring 38 is interconnected to the loop 50. Since the throttle link 30 is interconnected to the governor arm 26, the governor spring 38 applies a biasing force on the throttle link 30 and the governor arm 26, and biases the governor arm 26 in the first direction A.

Many alternatives of the governor 14 configuration may be used with the present invention. For example, the second end 46 of the governor spring 38 may be connected to governor arm 26. In the illustrated embodiment, the governor spring 38 is a coil spring, but it could also be a leaf spring, or another type of spring. The throttle link 30 and governor spring 38 could extend from the governor arm 26 in different directions. The governor spring 38 may be connected to a speed adjustment instead of a fixed portion of the engine 10 to vary the speed setting of the governor 14.

A stabilizer system 60 is interconnected to the governor 14 and helps reduce speed droop and other effects of engine speed change, such as hunting or searching. The stabilizer system 60 includes a damper 64 and a stabilizer spring 68. The damper 64 is connected to a fixed portion 70 on the engine 10. The stabilizer spring 68 is preferably interconnected between the damper 64 and the governor arm 26, and includes a first end 72 interconnected to the governor arm 26, and a second end 76 interconnected to the damper 64. In another embodiment, the stabilizer spring may be interconnected between the damper 64 and throttle link 30. In FIG. 3, the stabilizer spring 68 is illustrated as a coil spring, and in FIG. 4, the stabilizer spring 68 is illustrated as a leaf spring.

In FIGS. 3–4, the damper 64 includes a cylinder 80 and a rod 84 at least partially disposed within the cylinder 80. Preferably, the rod 84 is made from a metal or plastic material and may be solid or a hollow tube. The cylinder 80 is preferably made from a plastic or metal material, such as brass, and is tubular. The rod 84 is movable with respect to the cylinder 80. The configuration of the damper 64 and stabilizer spring 68 permits the stabilizer system 60 to initially resist movement of the governor arm 26. The stabilizer spring 68 applies a resistive force on the governor arm 26, and the stored energy of the stabilizer spring 68 then returns the damper 64 to a neutral rest position to reduce the resistive force of the stabilizer spring 68. Since the stabilizer spring 68 is interconnected to the damper 64 and the governor arm 26, the stabilizer system 60 resists sudden movement of the governor arm 26, but does not necessarily prevent movement of the governor arm 26.

In FIG. 3, the stabilizer spring 68 is interconnected to the rod 84, and the cylinder 80 is connected to the portion 70 on the engine 10. The damper 64 may also be reversed, with the stabilizer spring 68 interconnected to the cylinder 80, and the rod 84 connected to the engine 10. Additionally, the damper 64 and stabilizer spring 68 could be reversed, with the damper 64 interconnected to the governor arm 26, and the stabilizer spring 68 interconnected between the damper 64 and a fixed portion of the engine 10. The damper 64 and stabilizer spring 68 are preferably connected in series between the governor arm 26 and fixed portion of the engine 10.

In FIGS. 3–4, the damper 64 may provide pneumatic damping, friction damping, and/or viscous damping. The governor arm 26 pivots about a fixed point, so the first end 72 of the stabilizer spring 68 interconnected to the governor arm 26 travels in an arc-shaped path. Therefore, the stabilizer spring 68 and rod 84 may also travel in an arc-shaped path. The cylinder 80 may be connected to a fixed portion of the engine 10, and the rod 84 is free to move within the cylinder 80. As the rod 84 moves in an arc-shaped path, the rod 84 may contact the relatively straight cylinder 80 to create friction damping for the stabilizer system 60.

In the illustrated embodiment, a flexible mount 86 is disposed between the cylinder 80 and the fixed portion 70 of the engine 10. The flexible mount 86 may be made from rubber, or some other similar flexible, durable material. The flexible mount 86 permits the cylinder 80 to move slightly in relation to the engine 10 to accommodate the arc-shaped path of the rod 84. The flexible mount 86 and movable cylinder 80 helps align the rod 84 and cylinder 80, and helps reduce friction between the rod 84 and cylinder 80.

The cylinder 80 includes an open end 88 and a closed end 92. The closed end 92 may be interconnected to the engine 10, and the rod 84 may extend into the cylinder 80 through the open end 88. In the illustrated embodiment, the closed end 92 is interconnected to the engine 10 with the flexible mount 86. The outer diameter of the rod 84 is less than the inner diameter of the cylinder 80, and the rod 84 may move with respect to the cylinder 80. The fit between the rod 84 and the cylinder 80 is relatively close and may restrict air movement between the rod 84 and cylinder 80, but the fit is not airtight to prevent air from travelling between the rod 84 and cylinder 80.

As the rod 84 moves into the cylinder 80, the air within the cylinder 80 is under compression and resists movement of the rod 84. The rod 84 forces air out of the cylinder 80. As the rod 84 moves out of the cylinder 80, the air within the cylinder 80 creates a vacuum that resists movement of the rod 84. The movement of the rod 84 out of the cylinder 80 draws air into the cylinder 80. Once the air moves into or out of the cylinder 80, the pressure within the cylinder 80 is equalized and the resistive force of the stabilizer system 60 is reduced. Therefore, the damper 64 also provides pneumatic damping for the stabilizer system 60.

The damper 64 may also provide viscous damping. A light grease may be applied between the inner surface of the cylinder 80 and the rod 84. The grease provides a viscous damping between the cylinder 80 and the rod 84 and assists the stabilizer system 60 in providing a temporary resistance on the governor arm 26.

FIG. 3 illustrates the governor 14 including the stabilizer system 60. The stabilizer system 60 creates a temporary droop to stabilize the governor 14 and reduce hunting or searching. The temporary droop is then removed to permit the governor 14 to achieve the desired speed to help prevent permanent droop. The stabilizer spring 68 temporarily applies a force on the governor arm 26 that initially resists movement of the governor arm 26. The stabilizer system 60 causes a temporary speed droop to inhibit the governor arm 26 from moving too quickly. The initial resistance of the stabilizer spring 68 helps prevent the governor 14 from undershooting or overshooting the desired speed and hunting for the desired speed. Reducing hunting helps reduce surging and noise generated by the engine, and helps increase fuel efficiency of the engine.

Once the damper 64 returns to a neutral or equilibrium position, the stored energy in the spring 68 is released and the resistive force of the stabilizer spring 68 on the governor arm 26 is reduced. The stabilizer system 60 initially applies a resistive force that resists sudden movement of the governor arm 26, but the resistive force decreases as the movement of the governor arm 26 slows. As the resistive force is reduced, the temporary droop is also reduced, and the governor 14 may reach the desired engine speed. The stabilizer system 60 applies a temporary droop to help prevent unstable action or hunting. After the temporary droop is eliminated, the governor 14 may achieve the desired speed. Since the stabilizer system 60 slows movement of the governor 14, the governor 14 generally achieves the desired speed without excessive hunting or instability.

The damper 64 resists sudden movement, and causes the stabilizer spring 68 to apply a resistive force on the governor arm 26. The resistance provided by the stabilizer system 60 is generally proportional to the rate of movement of the governor arm 26. The stabilizer system 60 and stabilizer spring applies a greater resistive force during quick movement of the governor arm 26 than during slow movement of the governor arm 26. The stabilizer system 60 permits the governor 14 to include a governor spring 38 having a lower spring rate, which can accommodate slow movement of the governor arm 26. Quick movement of the governor arm 26 is generally the cause of hunting for a governor spring 38 having a low spring rate. The stabilizer system 60 generally provides a resistive force on the governor arm 26 when it moves quickly, and may have a minimal effect when it moves slowly.

The stabilizer system 60 performs a function similar to altering the spring rate of the governor spring 26 when needed to help reduce hunting and permanent droop, and achieves the benefits of selectively having a governor spring 38 with a high spring rate and a low spring rate. The stabilizer system 60 allows the governor 14 to include a governor spring 38 having a lower spring rate, while helping to prevent hunting. The lower spring rate may result in the governor 14 having no droop, or possibly even a speed gain, or negative droop. In a speed gain, the governor 14 may actually exceed the desired no-load engine speed after a load is applied on the engine, resulting in increased engine power output.

Figure 2:
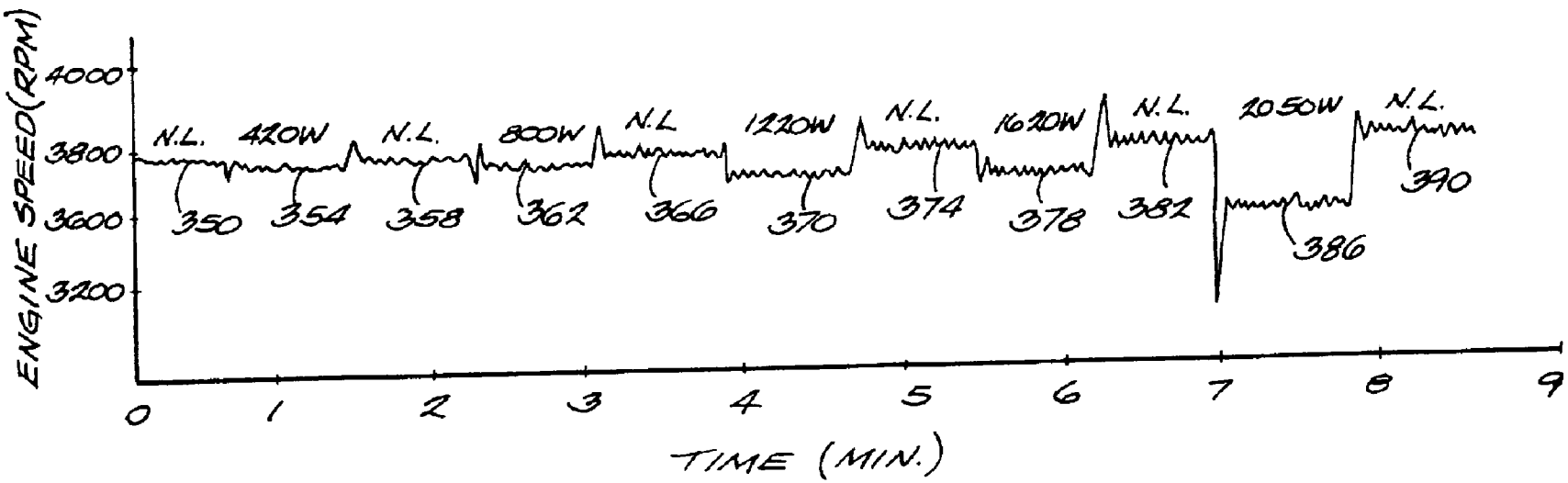
Fig. 2 PRIOR ART
FIG. 2 is a graph illustrating engine speed in response to loads for the prior art governor of FIG. 1.
Figure 5:
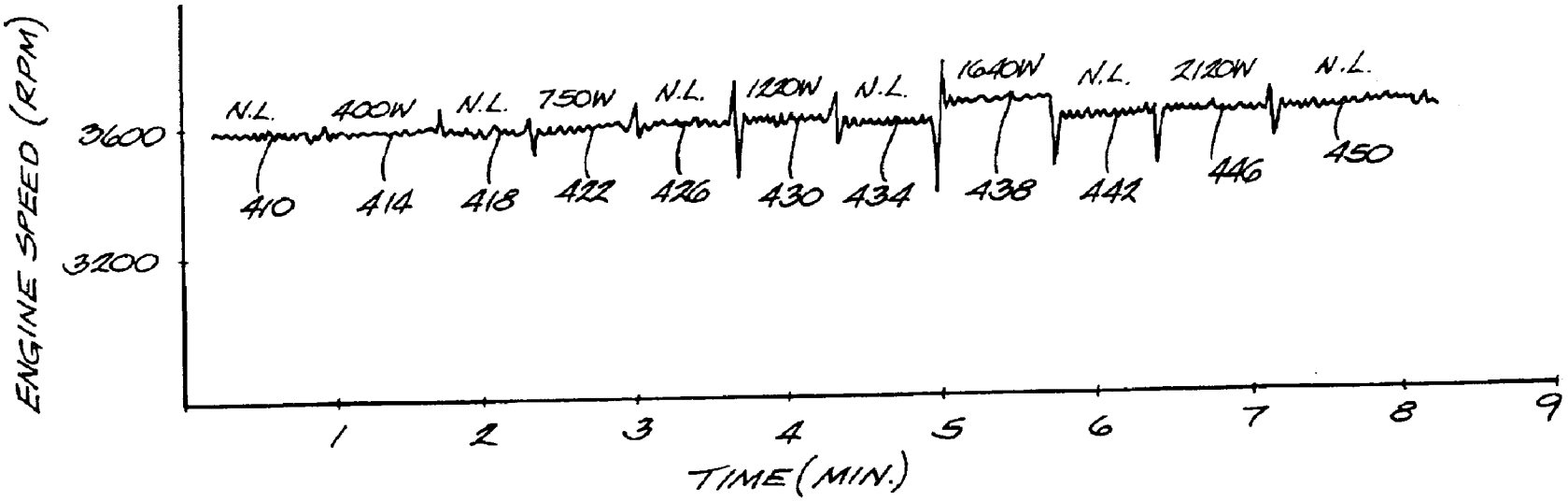
FIG. 5 is a graph illustrating engine speed in response to loads for the governor system including a stabilizer system of FIG. 3.

In FIG. 5, the graph illustrates test data of the engine speed over time in response to various loads placed on an engine having a governor 14 including a stabilizer system 60 (FIG. 4). The load on the engine was from a generator and is measured in Watts (W). The engine and generator for FIG. 5 were substantially the same as that used for Prior Art FIG. 2, a 2000 W, 60 Hertz (Hz) generator and a 5 HP engine, with the exception of the governor 14 including the stabilizer system 60 (FIG. 4) used in FIG. 5. The engine was again subjected to alternating periods of no load (represented by "N.L."), and incrementally increasing loads. In FIG. 5, the no-load speed is set at approximately 3600 rpm. Due to the lack of speed droop, the no-load engine speed may be set lower for the engine with the governor 14 and stabilizer system 60 (FIG. 4). Segments 410, 418, 426, 434, 442, and 450 illustrate the engine with no load at approximately 3600 rpm. Segments 414, 422, 430, 438, and 446 show the engine with incrementally increasing loads.

In FIG. 5, the engine speed returns to about the set no-load engine speed of 3600 rpm after each load is applied. In some instances, the engine speed actually increased above the no-load speed after the application of a load. At segment 438, the engine speed increases slightly above 3600 rpm after the 1640 W load is applied. This increase in speed shown at segment 438 after the application of the load is an example of the negative droop, or speed gain that may result from the governor 14 including the stabilizer system 60 shown in FIG. 4.

The stabilizer system 60 allows the engine 10 to maintain speed and power without setting the desired no-load speed of the governor 14 too high. Since permanent droop is reduced, the desired no-load speed may be lowered, which reduces noise emitted from the engine, and increases fuel efficiency. Additionally, the stabilizer system 60 helps reduce hunting, which also reduces noise emitted from the engine due to surging, and increases fuel efficiency.

Figure 6:
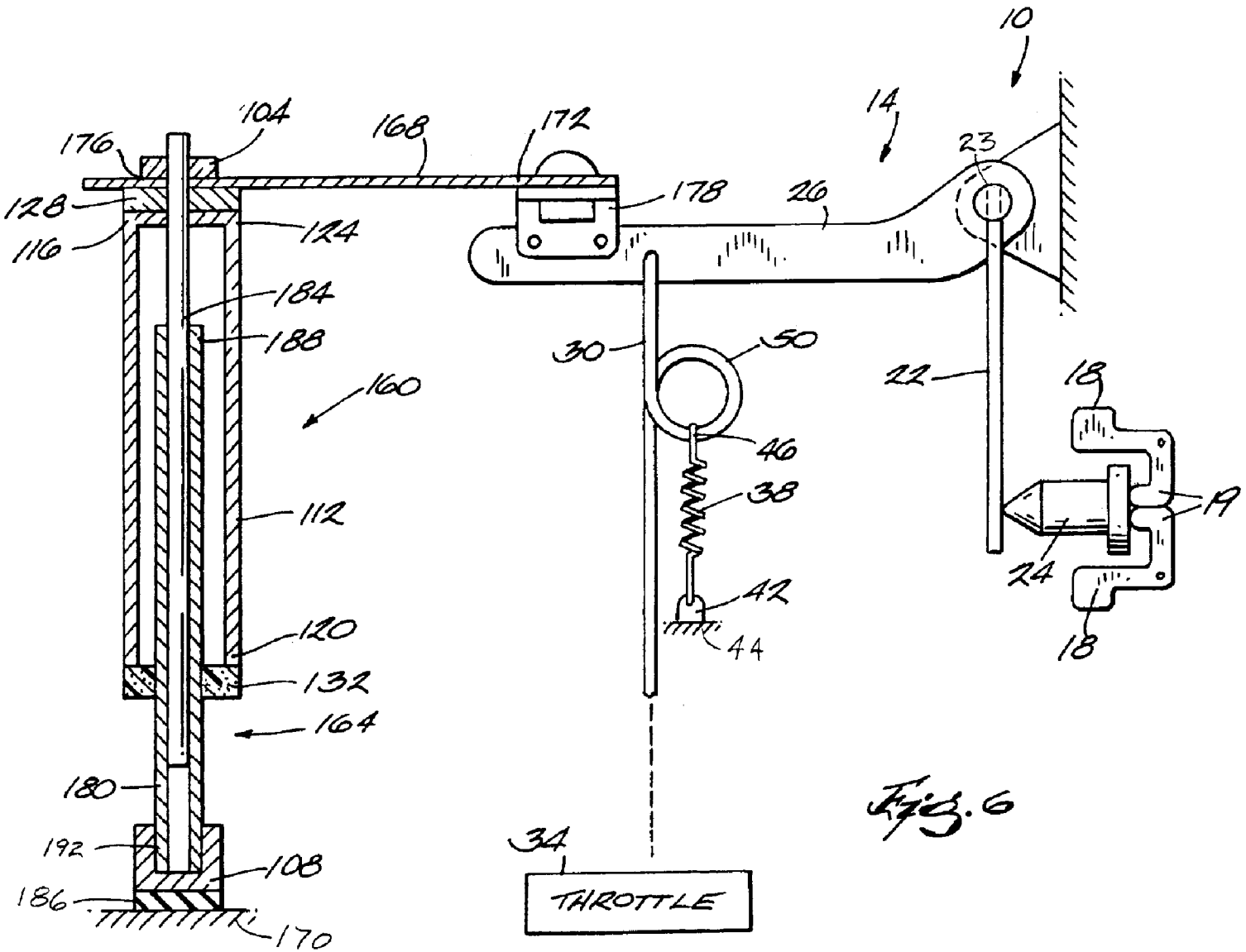
FIG. 6 is a diagram of another embodiment of a governor system including a stabilizer system.

FIG. 6 illustrates another embodiment of a stabilizer system 160 interconnected to the governor 14. The governor 14 shown in FIG. 6 is substantially the same as the governor 14 described above and shown in FIG. 3. The stabilizer system 160 illustrated in FIG. 6 functions similarly to the stabilizer system 60 described above and shown in FIG. 3. The stabilizer system 160 includes a damper 164 and a stabilizer spring 168. The damper 164 is mounted to a fixed portion 170 on the engine 10. The stabilizer spring 168 is interconnected between the damper 164 and the governor arm 26, and includes a first end 172 interconnected to the governor arm 26, and a second end 176 interconnected to the damper 164. In the illustrated embodiment, the stabilizer spring 168 is connected to the governor arm 26 with a clamp 178. In FIG. 6, the stabilizer spring 168 is a leaf spring made from a flexible material, such as metal or plastic.

The damper 164 includes a cylinder 180 and a rod 184 at least partially disposed within the cylinder 180. Similar to the embodiment described above, a flexible mount 186 may be disposed between the cylinder 180 and the fixed portion 170. The cylinder 180 includes an open end 188 and a closed end 192. The rod 184 extends into the open end 188 of the cylinder 180, and is movable with respect to the cylinder 180. The outer diameter of the rod 184 is preferably less than the inner diameter of the cylinder 180. In the illustrated embodiment, the rod 184 is interconnected to the stabilizer spring 168, and the cylinder 180 is connected to the engine 10. The end of the rod 184 may be threaded, and a fastener 104, such as a nut, may be used to connect the rod 184 to the stabilizer spring 168. The cylinder 180 may include a base 108 near the closed end 192 to help seal that end of the cylinder 180 and connect the cylinder 180 to the engine 10. The damper 164 could be reversed, with the stabilizer spring 168 interconnected to the cylinder 180, and the rod 184 connected to the engine 10.

The damper 164 also includes a sleeve 112 that at least partially surrounds the rod 184 and the cylinder 180. In FIG. 6, the sleeve 112 includes a first end 116 interconnected to the rod 184 near the stabilizer spring 168, and a second end 120 opposite the first end 116. The damper 164 may include a cap 124 disposed between the sleeve 112 and the stabilizer spring 168, near the first end 116 of the sleeve 112. The cap 124 may be integral with the sleeve 112, and may help seal the first end 116 of the sleeve 112. The damper 164 may also include a magnet 128 disposed near the first end 116 of the sleeve 112, between the sleeve 112 and the stabilizer spring 168. If the stabilizer spring 168 is made of metal, the magnet 128 may connect the damper 164 to the stabilizer spring 168. The fastener 104 may not be needed if the damper 164 includes the magnet 128.

The sleeve 112 helps prevent contaminants, such as dust, debris, or other particles, from entering the cylinder 180 and becoming lodged within the cylinder 180 or between the cylinder 180 and the rod 184. The rod 184 moves with respect to the cylinder 180, and there is a relatively close fit between the rod 184 and cylinder 180. Due to the movement of the rod 184, contaminants caught between the rod 184 and cylinder 180 could cause additional wear on the parts. The sleeve 112 may include a wiper 132 near the second end 120 of the sleeve 112 to help prevent contaminants from entering the sleeve 112 and the cylinder 180. Since the sleeve 112 also moves with respect to the cylinder 180, the wiper 132 may be made from a relatively soft material, such as felt, that does not damage the cylinder 180, but is still permeable to permit air to pass through the wiper 132.

In FIG. 6, the sleeve 112 is spaced apart from the cylinder 180. Alternatively, the sleeve 112 may be relatively close to the cylinder 180, similar to the fit between the cylinder 180 and the rod 184. In this embodiment, the tighter fit between the rod 184, cylinder 180, and sleeve 112 may provide a greater damping force for the damper 164. The damper 164 may also include a flexible seal interconnected to the cylinder 180 and the sleeve 112 to help prevent contaminants from entering the sleeve 112 and wearing on the sleeve 112 and cylinder, due to the tighter fit of the sleeve 112 and cylinder 180.

Figure 7:
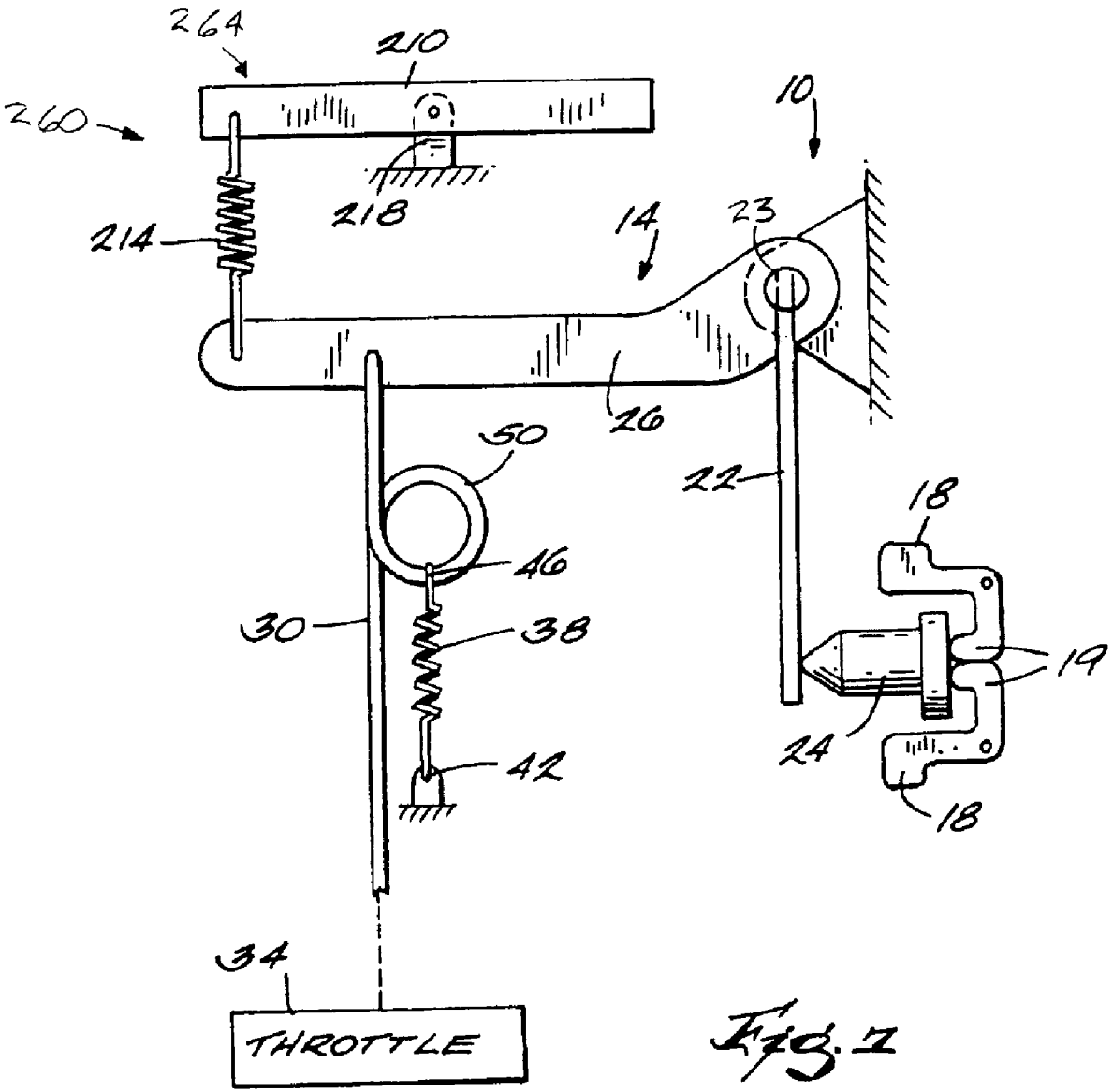
FIG. 7 is a diagram of yet another embodiment of a governor system including a stabilizer system.

FIG. 7 illustrates another embodiment of a stabilizer system 260 interconnected to the governor 14. In FIG. 7, the stabilizer system 260 includes a spring-mass damper 264 interconnected to the governor arm 26. The governor 14 is similar to the governor 14 described in the embodiments above. The damper 264 includes a mass 210. A spring 214 is interconnected between the mass 210 and the governor arm 26. In the illustrated embodiment, the mass 210 is pivotally connected to a bracket 218, and the bracket 218 is connected to a fixed portion of the engine 10. The mass 210 may pivot with respect to the engine 10.

As mentioned above, the governor arm 26 moves in response to changes in engine speed. As the governor arm 26 moves, the spring 214 initially applies a resistive force on the governor arm 26. Since the mass 210 is initially at rest, the mass 210 tends to stay at rest, and a certain amount of force is required to move the mass 210. When the governor arm 26 moves suddenly, the mass 210 remains at rest, and the spring 214 applies a resistive force on the governor arm 26. The stored energy in the spring 214 eventually causes the mass 210 to move, and the resistive force applied by the spring 214 is reduced as the mass 210 moves to a new rest position.

The foregoing detailed description describes only a few of the many forms that the present invention can take, and should therefore be taken as illustrative rather than limiting. It is only the claims, including all equivalents that are intended to define the scope of the invention.

What is claimed is:

1. An apparatus that controls the speed of an internal combustion engine having an engine throttle, comprising:

a governor that adjusts the position of the throttle to set the engine speed to a governed speed, including:

a governor arm assembly that moves in response to engine speed;

a throttle link interconnected to the governor arm assembly and to the throttle;

a stabilizer system, interconnected to the governor and operable during normal operating speeds, that provides a speed change in the engine speed for a period of time after the application of a load, the engine speed thereafter increasing to be at least substantially equal to the governed speed while the load is still applied.

2. The apparatus of claim 1, wherein the speed change comprises increasing the engine speed above the governed speed.

3. The apparatus of claim 1, the stabilizer system further comprising a stabilizer spring and a damper interconnected in series between the governor and a fixed portion of the engine.

4. The apparatus of claim 1, wherein the governor arm assembly includes a governor arm and a governor arm extension interconnected with the governor arm.

5. The apparatus of claim 1, the stabilizer system further comprising:

a stabilizer spring interconnected to the governor; and a damper interconnected to the stabilizer spring.

6. The apparatus of claim 5, wherein the stabilizer spring includes at least one of a coil spring and a leaf spring.

7. The apparatus of claim 5, wherein the damper includes a cylinder, and a rod at least partially disposed within the cylinder and movable with respect to the cylinder.

8. The apparatus of claim 7, wherein the stabilizer spring is interconnected to the rod and the governor.

9. The apparatus of claim 7, wherein the stabilizer spring is interconnected between the cylinder and the governor.

10. The apparatus of claim 7, wherein the damper includes a sleeve at least partially surrounding the cylinder and the rod.

11. The apparatus of claim 10, further comprising a wiper connected to the sleeve and contacting the cylinder.

12. The apparatus of claim 5, wherein the damper provides at least one of friction damping and pneumatic damping.

13. The apparatus of claim 5, wherein the damper provides both friction damping and pneumatic damping.

14. The apparatus of claim 1, wherein the stabilizer system includes a spring mass damper.

15. A governor assist device for an internal combustion engine having an engine housing, and having a governor arm assembly with a governor arm, and a throttle link interconnected to the governor arm assembly, the governor assist device being engageable with the governor arm assembly during normal operating speeds and comprising:

a damper and a stabilizer spring interconnected in series between the engine housing and the governor arm.

16. The governor assist device of claim 15, wherein the damper is interconnected to the engine housing, and the stabilizer spring is interconnected between the damper and the governor arm.

17. The governor assist device of claim 16, wherein the governor arm assembly includes a governor arm and a governor extension that engages the governor arm, and wherein the governor arm includes:

a pivot end adjacent the governor extension; and a free end disposed opposite the pivot end, wherein the stabilizer spring is interconnected to the governor arm adjacent the free end, and wherein the throttle link is interconnected to the governor arm and the governor extension.

18. The governor assist device of claim 15, wherein the damper includes a cylinder, and a rod at least partially disposed within the cylinder and movable with respect to the cylinder.

19. The governor assist device of claim 18, wherein the stabilizer spring is interconnected to the rod, and the cylinder is interconnected to the engine housing.

20. The governor assist device of claim 18, wherein the stabilizer spring is interconnected to the cylinder, and the rod is interconnected to the engine housing.

21. The apparatus of claim 18, wherein the damper includes a sleeve at least partially surrounding the cylinder and the rod.

22. The apparatus of claim 21, further comprising a wiper connected to the sleeve and contacting the cylinder.

23. The governor assist device of claim 15, wherein the damper provides at least one of friction damping and pneumatic damping.

24. The governor assist device of claim 15, wherein the damper provides both friction damping and pneumatic damping.

25. The governor assist device of claim 15, wherein the stabilizer spring includes at least one of a coil spring and a leaf spring.

26. The governor assist device of claim 15, wherein the governor arm assembly includes a governor arm and a governor extension that engages the governor arm.

27. A governor that adjusts a throttle for an internal combustion engine, the governor comprising:

a governor arm assembly including a governor arm that moves in response to engine speed;

a throttle link interconnected to the governor arm assembly and to the throttle; and a stabilizer spring and a damper interconnected in series between a fixed portion of the engine and the governor arm.

28. The governor of claim 27, wherein the stabilizer spring is interconnected to the governor arm assembly, and the damper is interconnected to the stabilizer spring.

29. The governor of claim 28, wherein the governor arm assembly includes a governor arm and a governor extension that engages the governor arm, and wherein the governor extension applies a first force on the governor arm, wherein the stabilizer spring applies a second force on the governor arm that opposes the first force during movement of the governor arm, and wherein the second is directly related to the rate of movement of the governor arm.

30. The governor of claim 27, wherein the damper includes a cylinder, and a rod at least partially disposed within the cylinder and movable with respect to the cylinder.

31. The apparatus of claim 30, wherein the damper includes a sleeve at least partially surrounding the cylinder and the rod.

32. The apparatus of claim 31, further comprising a wiper connected to the sleeve and contacting the cylinder.

33. The governor of claim 30, wherein the stabilizer spring is interconnected between the rod and the governor arm assembly.

34. The governor of claim 30, wherein the stabilizer spring is interconnected between the cylinder and the governor arm assembly.

35. The governor of claim 27, wherein the damper provides at least one of friction damping and pneumatic damping.

36. The governor of claim 27, wherein the damper provides both friction damping and pneumatic damping.

37. The governor of claim 27, further comprising a governor spring that biases the throttle link in a first direction and opposes movement of the throttle link in a second direction.

38. The apparatus of claim 1, wherein normal operating speeds include engine speeds of at least 3,200 rpm.

39. The governor assist device of claim 15, wherein normal operating speeds include engine speeds of at least 3,200 rpm.

40. A governor assist device for an internal combustion engine having an engine housing, and having a governor including a governor arm assembly, and a throttle link interconnected to the governor arm assembly, the governor assist device being engageable with the governor during normal operating speeds and comprising:

a damper and a stabilizer spring interconnected in series between the engine housing and the governor, wherein the damper includes a cylinder, and a rod at least partially disposed within the cylinder and movable with respect to the cylinder.

41. A governor that adjusts a throttle for an internal combustion engine, the governor comprising:

a governor arm assembly that moves in response to engine speed;

a throttle link interconnected to the governor arm assembly and to the throttle; and a stabilizer spring and a damper interconnected in series to a fixed portion of the engine, wherein the damper includes a cylinder, and a rod at least partially disposed within the cylinder and movable with respect to the cylinder.

* * * * *